252-99 AU 157 EX
7/8/86 XR 4,599,186

United States Patent [19]

Choy et al.

[11] Patent Number: 4,599,186

[45] Date of Patent: Jul. 8, 1986

[54] THICKENED AQUEOUS ABRASIVE SCOURING CLEANSER

[75] Inventors: Clement K. Choy, Walnut Creek; Frederick I. Keen, Livermore, both of Calif.

[73] Assignee: The Clorox Company, Oakland, Calif.

[21] Appl. No.: 603,266

[22] Filed: Apr. 20, 1984

[51] Int. Cl.[4] ..... C11D 1/75; C11D 1/83; C11D 3/14; C11D 3/395

[52] U.S. Cl. ..... 252/102; 252/95; 252/99; 252/155; 252/174.25; 252/DIG. 14

[58] Field of Search ..... 252/95, 99, 102, 174.25, 252/DIG. 14, 140, 155; 51/308, 304

[56] References Cited

U.S. PATENT DOCUMENTS

| | | | |
|---|---|---|---|
| 2,489,848 | 11/1949 | Bacon et al. | 252/138 |
| 3,042,622 | 7/1962 | Kirschenbauer | 252/99 |
| 3,149,078 | 9/1964 | Zmoda | 252/99 |
| 3,446,893 | 5/1969 | Hanford et al. | 424/76 |
| 3,530,071 | 9/1970 | Moore | 252/99 |
| 3,558,496 | 1/1971 | Zmoda | 252/95 |
| 3,560,389 | 2/1971 | Hunting | 252/95 |
| 3,579,456 | 5/1971 | Cambre | 252/155 |
| 3,630,922 | 12/1971 | McClain et al. | 252/99 |
| 3,677,954 | 7/1972 | Nakajima et al. | 252/121 |
| 3,684,722 | 3/1972 | Hynam et al. | 252/98 |
| 3,702,826 | 11/1972 | Koceich et al. | 252/99 |
| 3,715,314 | 2/1973 | Morgenstern | 252/95 |
| 3,716,488 | 2/1973 | Kolsky et al. | 252/155 |
| 3,758,409 | 9/1973 | Nakagawa et al. | 252/99 |
| 3,843,548 | 10/1974 | James | 252/187 |
| 3,929,661 | 12/1975 | Nakagawa et al. | 252/103 |
| 3,956,158 | 5/1976 | Donaldson | 252/102 |
| 3,981,826 | 9/1976 | Munro | 252/526 |
| 3,985,668 | 10/1976 | Hartman | 252/99 |
| 4,005,027 | 1/1977 | Hartman | 252/95 |
| 4,011,172 | 3/1977 | Marsan et al. | 252/187 |
| 4,029,591 | 6/1977 | Ohbu et al. | 252/95 |
| 4,051,055 | 9/1977 | Trinh | 252/95 |
| 4,051,056 | 9/1977 | Hartman | 252/99 |
| 4,057,505 | 11/1977 | Nakagawa et al. | 151/96 |
| 4,062,647 | 12/1977 | Storm et al. | 8/137 |
| 4,071,463 | 1/1978 | Steinhauer | 252/103 |
| 4,079,015 | 3/1978 | Paycot et al. | 252/95 |
| 4,116,849 | 9/1978 | Leikhim | 252/103 |
| 4,116,851 | 9/1978 | Rupe et al. | 252/103 |
| 4,122,025 | 10/1978 | Kiewert et al. | 252/173 |
| 4,129,527 | 12/1978 | Clark | 252/547 |
| 4,133,779 | 1/1979 | Hellyer et al. | 252/547 |
| 4,158,553 | 6/1979 | Chapman | 51/304 |
| 4,174,289 | 11/1979 | Sorgenfrei et al. | 252/103 |
| 4,181,633 | 1/1980 | Colodney et al. | 252/525 |
| 4,203,858 | 5/1980 | Chakrabarti | 252/135 |
| 4,229,313 | 10/1980 | Joy | 252/98 |
| 4,235,732 | 11/1980 | Beyer | 252/103 |
| 4,240,919 | 12/1980 | Chapman | 252/95 |
| 4,248,728 | 2/1981 | Puryear | 252/103 |
| 4,271,030 | 6/1981 | Brierley et al. | 252/98 |
| 4,282,109 | 8/1981 | Citrone et al. | 252/102 |
| 4,283,533 | 8/1981 | Imamura et al. | 252/542 |
| 4,287,079 | 9/1981 | Robinson | 252/99 |
| 4,302,347 | 11/1981 | Straw et al. | 252/116 |
| 4,337,163 | 6/1982 | Schilp | 252/96 |
| 4,352,678 | 10/1982 | Jones et al. | 51/307 |
| 4,379,080 | 4/1983 | Murphy | 252/526 |
| 4,388,204 | 6/1983 | Dimond et al. | 252/98 |
| 4,394,179 | 7/1983 | Ellis et al. | 134/7 |
| 4,396,525 | 8/1983 | Rubin et al. | 252/174.25 |
| 4,397,755 | 8/1983 | Brierley et al. | 252/113 |
| 4,399,056 | 8/1983 | Shipley | 252/431 |
| 4,438,016 | 3/1984 | Kiewart et al. | 252/174.25 |
| 4,508,634 | 4/1985 | Elepaño et al. | 252/163 |

FOREIGN PATENT DOCUMENTS

| | | |
|---|---|---|
| 1120370 | 3/1982 | Canada . |
| 3625 | 8/1979 | European Pat. Off. . |
| 886046 | 1/1941 | France . |
| 6806824 | 10/1968 | South Africa . |
| 522097 | 6/1940 | United Kingdom . |
| 1418671 | 12/1975 | United Kingdom . |
| 1534680 | 12/1978 | United Kingdom . |
| 2031455 | 2/1983 | United Kingdom . |

OTHER PUBLICATIONS

"Conoco Catapal ® SB Alumina," Jan. 1981.
"Condea High Purity Aluminas."
"Remet Chemical Corporation, Product Data," Jan. 12, 1981; May 4, 1981.

*Primary Examiner*—Prince E. Willis
*Attorney, Agent, or Firm*—Joel J. Hayashida; Stephen M. Westbrook

[57] ABSTRACT

The invention provides a thickened aqueous abrasive scouring cleanser containing bleach which is capable of stably suspending abrasives, has excellent shelf stability for a commercially feasible product with substantially no syneresis, does not require shaking before use, and maintains these advantages over extended times and at elevated temperatures.

The inventive cleansers comprise generally the following ingredients:
(a) hydrated aluminum oxide;
(b) an electrolyte/buffer;
(c) at least one surfactant;
(d) a bleach; and
(e) a particulate abrasive.

22 Claims, No Drawings

THICKENED AQUEOUS ABRASIVE SCOURING CLEANSER

TECHNICAL FIELD

This invention relates to thickened aqueous scouring cleansers which contain abrasives and a bleach source.

BACKGROUND OF THE INVENTION

In the quest for hard surface cleaners which have efficacy against a variety of soils and stains, various heavy duty cleansers have been developed. As an example, U.S. Pat. No. 3,985,668 issued to Hartman, shows a combination of perlite (an expanded silica abrasive, which is here used as a filler), a colloid-forming clay, in combination with a hypochlorite bleach, a surfactant and a buffer in which abrasives are suspended. A clay thickened system of this type tends to set up or harden upon storage due to the false body nature of the thickeners. They require shaking before use to break down the false body structure. Further prior art cleaners which attempt to suspend abrasives use inorganic colloid thickeners only. Additionally, syneresis becomes a problem as the solids portion of such cleansers substantially separate from the liquids portion. One way to alleviate this is to use a perlite type material with specified particle size as defined in U.S. Pat. No. 3,985,668, issued to Hartman. Additionally, high levels of surfactants can be used to form a plastic rheology for suspension of abrasives. However, they have a detrimental effect on hypochlorite stability. These mixed surfactant thickened compositions, for example, U.S. Pat. No. 4,352,678, issued to Jones et al, have been used to suspend abrasives and incorporate a source of hypochlorite bleach. However, this particular reference must incorporate large amounts of surfactants in order to suspend abrasives. This has the unfortunate disadvantage of resultant poor hypochlorite stability in terms of half-life stability at 50° C. for low levels of hypochlorite (0.5% sodium hypochlorite initial level). For the instant purpose, half-life stability is defined as the amount of time it takes for 50% of the initial amount of bleach present in a given composition to decompose.

Other efforts in the cleanser field have included: U.S. Pat. No. 4,337,163, issued to Schilp, which related to a bleach thickened with a combination of amine oxides and anionic surfactants. Abrasives are unable to be suspended in the Schilp formulas. U.S. Pat. No. 4,287,079, on the other hand, related to a clay/silicon dioxide thickened, bleach-containing abrasive cleanser which could contain an anionic surfactant. Due to the clay-thickened rheology, cleansers of this sort quickly dry out and set up. While these type of cleansers thus become less flowable over time, they are unfortunately also plagued by significant syneresis problems. U.S. Pat. No. 3,956,158, (also British Pat. No. 1,418,671) issued to Donaldson shows an abrasive-containing bleach thickened with insoluble detergent filaments. As described in U.S. Pat. No. 4,352,678, compositions such as those disclosed in U.S. Pat. No. 3,956,158 have numerous disadvantages, including low detergency and lack of physical and chemical stability at higher temperatures.

There therefore remains a need for a thickened hard surface cleanser which is capable of suspending abrasives, exhibits no syneresis over time, does not require shaking before use and has long-term bleach stability.

SUMMARY OF THE INVENTION

In one aspect of the invention, is disclosed a hard surface abrasive scouring cleanser comprising:

(a) hydrated aluminum oxide;
(b) an electrolyte/buffer;
(c) at least one surfactant;
(d) a bleach; and
(e) a particulate abrasive.

The hard surface abrasive scouring cleansers of the invention provide excellent abrasive suspending and bleach stability in terms of long term half life. Additionally, the cleansers of the invention also show unexpectedly substantially no syneresis. These syneresis values are also stable over time and at elevated temperatures. Because of the resulting physical stability, the cleansers do not require shaking before use in order to fluidize the formulation and make it easy to dispense or resuspend solid abrasives.

A further embodiment of the invention provides an aqueous hard surface abrasive cleanser with substantially no syneresis comprising:

(a) an alumina thickener;
(b) a mixed surfactant system which comprises at least one anionic surfactant and one bleach-stable nonionic surfactant;
(c) an electrolyte/buffer;
(d) a bleach; and
(e) a particulate abrasive.

It is therefore an object of this invention to provide an aqueous hard surface abrasive scouring cleanser which has the ability to stably suspend abrasive particles.

It is a further object of this invention to provide a hard surface abrasive scouring cleanser which has substantially no syneresis, which is stable over time and at elevated temperatures.

It is a still further object of this invention to provide a hard surface abrasive scouring cleanser which has an excellent shelf stability in terms of bleach half-life.

It is another object of this invention to provide an aqueous hard surface abrasive cleanser which, due to lesser amounts of actives—e.g., surfactants—utilized, reduces cost as well as provides an effective cleanser.

It is yet another object of this invention to provide an aqueous hard surface abrasive cleanser while does not require shaking before use to resuspend abrasives and other solids.

It is still another object of this invention to provide an aqueous hard surface abrasive cleanser which does not set up or harden over time and therefore remains easily flowable.

It is a further object of this invention to provide an aqueous scouring abrasive cleanser which has demonstrated cleaning efficacy on soap scums, oily soils, and oxidizable stains, e.g., organic stains.

DETAILED DESCRIPTION OF THE INVENTION

The invention provides a hard surface abrasive scouring cleanser having no significant syneresis, stably suspends abrasives, and has excellent bleach half-life. All of the foregoing advantages are present even after these compositions have been tested over time and subjected to elevated temperatures.

Furthermore, as compared to prior art cleaners which include high levels of mixed surfactants, the present invention provides a stably suspended abrasive scouring cleanser which uses relatively small amounts of surfactants which thus lowers the total cost of producing these cleansers.

In one embodiment, the invention provides a hard surface abrasive scouring cleanser comprising:

(a) hydrated aluminum oxide;
(b) an electrolyte/buffer;
(c) at least one surfactant
(d) a bleach; and
(e) a particulate abrasive.

The crucial ingredients in the invention are the thickeners, namely, an alumina, or hydrated aluminum oxide, and a surfactant which can be anionic, bleach-stable nonionic amphoteric, zwitterionic, or mixtures thereof. Preferably, a mixture of surfactants will be used in the cleansers of this invention. Each of the individual constituents of this invention are profiled in more detail as follows:

Alumina

The colloidal thickening component of this invention is provided by an alumina, or hydrated aluminum oxide. A typical alumina is Dispural ®, distributed by Remet Chemical Corp., Chadwicks, N.Y., and manufactured by Condea Chemie, Brunsbuettel, West Germany. Dispural ® is an aluminum oxide monohydrate which forms stable colloidal aqueous dispersions. These particular types of aluminas are dry powders which can form thixotropic gels, bind silica and other ceramic substrates, possess a positive charge, and are substantive to a variety of surfaces. Dispural ® has a typical chemical composition of 90% alpha aluminum oxide monohydrate (boehmite ) 9% water, 0.5% carbon (as primary alcohol), 0.008% silicon dioxide, 0.005% ferric oxide, 0.004% sodium silicate, 0.05% sulfur. It has a surface area (BET) of about 320 $m^2$/gm, average particle size (as determined by sieving) of 15% (greater than 45 microns) and 85% (less than 45 microns), an X-ray diffraction dispersion of 0.0048 micron, and bulk density of 45 lbs./$ft.^3$(loose bulk) and 50 lbs./$ft.^3$ (packed bulk). Yet another alumina suitable for use, albeit not as preferred, is Catapal ® SB Alumina, manufactured by Conoco Chemicals Company, Houston, Tx. Catapal ® SB has a typical chemical composition of 74.2% aluminum oxide (boehmite), 25.8% water, 0.36% carbon, 0.008% silicon dioxide, 0.005% ferric oxide, 0.004% sodium oxide, and less than 0.01% sulfur. It has a surface area (BET) of 280 $m^2$/gm, average particle size (as determined by sieving) of 38% (less than 45 microns) and 19% (greater than 90 microns).

The preferred hydrated aluminas are derived from boehmite. More importantly, however, the hydrated aluminas used herein must be chemically insoluble, i.e., must not dissolve in reasonably acidic, basic or neutral media.

Surfactants

As mentioned herein above, the surfactants suitable for use in this invention are selected from anionic, bleach-stable nonionic, amphoteric, zwitterionic surfactants and mixtures thereof. It is especially preferred to use a combination of anionics and bleach-stable nonionics.

The anionic surfactants are selected from bleach/stable surfactants such as alkali metal alkyl sulfates, secondary alkane sulfonates, linear alkyl benzene sulfonates, and mixtures thereof. These anionic surfactants will preferably have alkyl chain groups averaging about 8 to 20 carbon atoms. In practice, any other anionic surfactants which do not degrade chemically when in contact with a hypohalite, e.g., hypochlorite, bleaching species should also work. An example of a particularly preferred secondary alkane sulfonate is HOSTAPUR SAS, manufactured by Farbwerke Hoechst A.G., Frankfurt, West Germany. An example of typical alkali metal salts of alkyl benzene sulfonic acids are those sodium alkyl benzene sulfonates manufactured by Pilot Chemical Company sold under the trademark Calsoft ®. An example of a typical alkali metal alkyl sulfate is Conco Sulfate WR, sold by Continental Chemical Company which has an alkyl group of about 16 carbon atoms.

Examples of preferred bleach-stable surfactants are amine oxides, especially trialkyl amine oxides. A representative structure is set forth below in FIG. I.

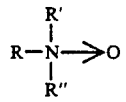

FIG. I.

In FIG. I above, R' and R'' can be alkyl of 1 to 3 carbon atoms, and are most preferably $CH_3$—, and R is alkyl of about 10 to 20 carbon atoms. When R' and R'' are both $CH_3$— and R is alkyl of averaging about 12 carbon atoms, the structure for dimethyldodecylamine oxide, a particularly preferred amine oxide, is obtained. Representative examples of this particular type of bleach-stable nonionic surfactants include the dimethyldodecylamine oxides sold under the trademark Ammonyx ® LO by Onyx Chemical Division of Millmaster Onyx Group. Yet other preferred amine oxides are those sold under the trademark Barlox ®, by Lonza, Inc. Still others include the Conco XA series, sold by Continental Chemical Company, the Aromax series sold by Armak Industrial Chemical Company, and the Schercamox series, sold by Scher Chemicals, Inc. These amine oxides preferably have main alkyl chain groups averaging about 10 to 20 carbon atoms. Other types of suitable surfactants include amphoteric surfactants, exemplary of which are betaines, imidazolines and certain quaternary phosphonium and tertiary sulfonium compounds. Particularly preferred are betaines such as N-carboxymethyl-N-dimethyl-N- (9-octadecenyl) ammonium hydroxide and N-carboxymethyl-N- cocoalkyl-N-dimethyl ammonium hydroxide, the latter of which is sold under the trademark Lonzaine ® by Lonza Corporation. Yet other acceptable surfactants are the zwitterionic surfactants exemplified in U.S. Pat. No. 4,005,029, issued to Jones, columns 11-15 of which are incorporated herein by reference.

As mentioned previously, it is particularly preferred to combine at least two of these surfactants, most preferably the anionics and the bleach stable nonionics. Combinations of these types of surfactants appear to be particularly favorable for maintaining hypochlorite half-life stability at elevated temperatures for long periods of time. Additionally, when these particular combinations of surfactants are combined with the alumina thickener, the formulations thus produced are practically free from syneresis.

Determining an appropriate mixture of alumina and surfactants is very important to the invention. While theoretically anywhere from about 1% to 25% alumina can be used, and about 0.1 to 15% surfactants (anionic, bleach-stable anionic, amphoteric or mixtures thereof), so long as desirable bleach stability and lack of phase separation or syneresis result, in practice it is preferred to use minimal quantities of these "actives." The amount of each active added is dictated by the type of product performance desired, i.e., thickening, cleaning, lack of or substantially no syneresis, abrasive suspending or bleach stabilizing. Applicants have found that preferably about 2% to 10%, and most preferably about 3% to 8% alumina, and preferably about 0.25% to 5.0%, most preferably about 0.5% to 3.0% of total surfactant are used in the cleansers of this invention. These ranges result in compositions having the desired syneresis values, ability to suspend abrasives, optimal bleach half-lives, and, because of the reduced amount of actives in the compositions, lower overall raw materials costs. It is crucial to use this combination of alumina and surfactants. As mentioned, using a mixed surfactant system alone, in high amounts to provide proper rheology for suspension of abrasives, results in reduced bleach half-life when a bleach is incorporated. Alumina, by itself, on the other hand, provides a composition with unacceptable syneresis.

However, with respect to optimal bleach stability, therefore also shelf stability in terms of bleach half-life, and syneresis values, it has been further surprisingly discovered that there is a most preferred total amount of surfactant present, namely, 0.5% to 3.0% by weight of the cleanser. This range thus appears to be a critical range, since exceeding it tends to lessen the bleach stability and may also increase syneresis values, although acceptable products may still occur at higher levels and are still considered part of this invention. Total surfactant levels below this range may not successfully suspend abrasives and lessen overall performance attributes of the cleansers, although such lower levels are still within the invention. As shown in TABLES II–IV below, best results occur with this critical range of surfactant and when the two different types of surfactant are used, namely anionic and bleach-stable nonionic.

Electrolytes/Buffers

The electrolyte/buffers appear to promote the favorable environment in which the surfactants and the alumina can associate. These particular buffers/electrolytes are generally the alkali metal salts of various inorganic acids, which include the alkali metal salts of phosphates, polyphosphates, pyrophosphates, triphosphates, tetrapyrophosphates, silicates, metasilicates, polysilicates, carbonates, hydroxides, and mixtures of the same. Certain divalent salts, e.g., alkaline earth salts of phosphates, carbonates, hydroxides, etc., can function singly as buffers. If such compounds were used, they would be combined with at least one of the previous electrolytes/buffers mentioned to provide the appropriate pH adjustment. It may also be suitable to use as buffers such materials as aluminosilicates (zeolites), borates, aluminates and bleach-stable organic materials, such as gluconates, succinates, maleates, and their alkali metal salts. These electrolyte/buffers function to keep the pH ranges of the inventive cleansers preferably above 7.0, more preferably at between about 10.0 to 14.0. The amount of electrolyte/buffer can vary from about 1.0% to 25.0%.

Halogen Bleach

A source of bleach is selected from various halogen bleaches. For the purposes of this particular invention, halogen bleaches are particularly favored. As examples thereof, the bleach may be preferably selected from the group consisting essentially of the alkali metal and alkaline earth salts of hypohalite, hypohalite addition products, haloamines, haloimines, haloimides and haloamides. These also produce hypohalous bleaching species in situ. Preferred is hypochlorite. Representative hypochlorite producing compounds include sodium, potassium, lithium and calcium hypochlorite, chlorinated trisodium phosphate dodecahydrate, potassium and sodium dichloroisocyanurate, trichloroisocyanuric acid, dichlorodimethyl hydantoin, chlorobromo dimethylhydantoin, N-chlorosulfamide, and chloramine. Particularly preferred in this invention is sodium hypochlorite having the chemical formula NaOCl, in an amount ranging from about 0.25% to about 15%, more preferably about 0.25% to 5%, most preferably about 0.5% to 2.0%. The purpose for the bleach is evident. This particular sort of oxidizing cleaning agent is very effective against oxidizable stains, e.g., organic stains. The principle problem with bleach is also apparent—in combination with most actives in an aqueous system, oxidation occurs, and the bleach's efficacy can be greatly reduced. As mentioned, it is particularly surprising that in the composition of this invention, bleach stability as expressed in half-lives is so excellent, which, in a commercial setting, is a necessary requirement to market a shelf-stable product that maintains its efficacy throughout its shelf-life. Excessive decomposition of hypochlorite is also detrimental since oxygen gas is evolved and can cause a pressure to build up in the package of an overly foamy product.

Abrasives

Abrasives are used in the invention to promote cleaning action by providing a scouring action when the cleansers of the invention are used on hard surfaces. Preferred abrasives include silica sand, but other hard abrasives such as a perlite, which is an expanded silica, and various other insoluble, inorganic particulate abrasives can be used, such as quartz, pumice, calcium carbonate, feldspar, talc, melamine granules, urea formaldehyde, tripoly and calcium phosphate. Abrasives can be present in amounts ranging from about 5 to 70%, and more preferably between 20 and 50%, by weight of the compositions of this invention.

Further desirable adjuncts include bleach stable dyes (e.g., anthraquinone dyes), pigments (e.g., ultramarine blue), colorants and fragrances in relatively low amounts, e.g., about 0.001% to 5.0% by weight of the composition.

The invention can be further exemplified by the results shown below.

TABLE I shows typical ranges for the compositions of this invention, TABLE II shows the favorable syneresis displayed by these cleansers, and TABLES III–IV show the surprising hypochlorite half-lives displayed by the cleansers of this invention over an extended period of time and at elevated temperature. Further, TABLES V–VII show performance benefits of these cleansers against various stains.

TABLE I

| FORMULA[1] | PERCENT $Al_2O_3.H_2O$ | PERCENT BUFFER | PERCENT ACTIVE ANIONIC SURFACTANT[2] | PERCENT ACTIVE AMINE OXIDE[3] | PERCENT NaOCl, INITIAL |
|---|---|---|---|---|---|
| 1 | 6 | 5[4] | 1 | 1 | 0.842 |
| 2 | 5 | 5[4] | 0.5 | 1 | 0.848 |
| 3 | 5 | 5[4] | 1 | 0.5 | 0.846 |
| 4 | 5 | 3.5[4] | 1.5 | 0.5 | 0.842 |
| 5 | 6 | 3.5[4] | 1.5 | 1 | 0.848 |
| 6[6] | 4.5 | 4.5[5] | 0.875 | 0.8 | 0.851 |
| 7[6] | 4.5 | 5[5] | 1.25 | 0.8 | 0.896 |
| 8[6] | 5 | 5[5] | 0.875 | 0.8 | 0.899 |
| 9 | 5 | 5 | 1 | — | — |
| 10 | 5 | 5 | — | 1 | — |

[1]In addition to materials listed, all formulas contain 30% silica sand, 3% tetrapotassium pyrophosphate, and deionized water.
[2]Secondary alkane sulfonate (Hostapur SAS)
[3]Dimethyldodecylamine oxide (Ammonyx LO)
[4]$Na_3PO_4$
[5]$K_3PO_4$
[6]Samples also contain 0.075% fragrance oils.

TABLE II

SYNERESIS VALUES FOR EXAMPLES 1-10

| EXAMPLE | PERCENT SYNERESIS LAYER[1] |
|---|---|
| 1 | 0% (3)[2] |
| 2 | 0% (3)[2] |
| 3 | 0% (3)[2] |
| 4 | 0% (3)[2] |
| 5 | 0% (3)[2] |
| 6 | 0% (3)[2] |
| 7 | 0% (3)[2] |
| 8 | 0% (3)[2] |
| 9 | 11% (2)[2] |
| 10 | 15% (2)[2] |

[1]Syneresis is defined as percentage of supernatant liquid over the suspension.
[2]Number in parenthesis indicates months the examples have been stored at 70° F.

TABLE II shows that examples 1-8 listed in TABLE I had substantially no syneresis for three months. This indicates lengthy physical stability which serves as commercial product very well. If only one surfactant, as in Examples 9-10, is used, less desirable syneresis occurs, but such Examples are still within the invention.

TABLE III

NaOCl HALF-LIVES (AT 120° F.) FOR EXAMPLES 1-10

| EXAMPLE | NaOCl HALF-LIFE AT 120° F., HOURS |
|---|---|
| 1 | 288 |
| 2 | 264 |
| 3 | 576 |
| 4 | 480 |
| 5 | 408 |
| 6 | 288 |
| 7 | 288 |
| 8 | 264 |
| 9 | —* |
| 10 | —** |

*Expected to exhibit most NaOCl remaining.
**Expected to exhibit lower remaining NaOCl.

TABLE III shows that each of the examples in TABLE I has excellent hypochlorite bleach half-life at elevated temperatures over a number of days, not merely hours. The most preferred stabilities show half-lives exceeding about 250 hours (about 10½ days) at 120° F. Additionally, it is surprising that such a high concentration (over 0.88) would remain stable for such extended periods, since in previous formulas depicted in the art, bleach half-life stability was fairly poor even when low amounts (0.5% or less) of bleach were initially present.

TABLE IV below shows NaOCl stabilities at room temperature (70° F.).

TABLE IV

NaOCl HALF-LIVES (AT 70° F.) FOR EXAMPLES 1-10

| EXAMPLE | % NaOCl REMAINING AT 70° F., DAYS |
|---|---|
| 1 | 67 (155 days) |
| 2 | 64 (155 days) |
| 3 | 82 (144 days) |
| 4 | 81 (163 days) |
| 5 | 59 (167 days) |
| 6 | 76 (120 days) |
| 7 | 73 (120 days) |
| 8 | 73 (120 days) |
| 9 | —* |
| 10 | —** |

*Expected to exhibit most NaOCl remaining.
**Expected to exhibit lower remaining NaOCl.

These particular examples show that the cleansers of this invention have actual application as commercial products. For the instant purpose, acceptable values for % remaining NaOCl are at least 50% remaining NaOCl after about five months.

Performance of the inventive composition was compared against commercially available cleansers. For comparison TABLES V-VII, the following formula was used:

EXAMPLE 11

| INGREDIENT | WEIGHT % |
|---|---|
| Dispural ® [1] | 5% |
| Hostapur SAS ® [2] | 0.0875% |
| Ammonyx ® LO[3] | 0.8% |
| $K_3PO_4$[4] | 5% |
| $K_4P_2O_7$[4] | 3% |
| NaOCl | 0.8% |
| $TiO_2$[5] | .75% |
| Fragrance | 0.04% |
| Silica Sand (140 mesh) | 30% |
| Water | Balance |

[1]$Al_2O_3.H_2O$, manufactured by Condea Chemie, Brunsbuettel, West Germany.
[2]Secondary alkane sulfonate surfactant, manufactured by Farbwerke Hoechst A. G., Frankfurt, West Germany.
[3]Amine oxide surfactant, manufactured by Onyx Chemical Division of Millmaster Onyx Corporation.
[4]Buffer/electrolyte.
[5]Pigment.

For TABLE V below, the oily-grease soil removal capacity of Example 11 was compared against those of three commercial cleansers. In the results that follow, the inventive formula out-performed all the compared commercial products.

In TABLE V, Gardner Soil Removal protocol was followed. An oily/grease soil was prepared by mixing vegetable oil and/lard. A 150 micron layer was laid on a porcelain steel panel. This was tested on a Gardner Heavy Duty Wear Tester No. 249 (Gardner Laboratories, Baltimore, Md.), the scrubbing sponge having a water content of 5:1 (water:sponge) (100 ppm 3:1 $Ca^{++}$:$Mg^{++}$ water hardness). 3 grams of each tested product were used in cleaning, except that Comet® powder cleanser was applied as 4 grams of a 3:1 product: water slurry. The cleaning results were graded by an impartial panel of five judges, who were not told what the products were, grading on a 1 to 10 scale, wherein 1=no cleaning and 10=total cleaning. The results were the average of 10 replicates.

TABLE V

| OILY-GREASE SOIL REMOVAL | |
|---|---|
| PRODUCT | VISUAL GRADE |
| Example 11 | 6.9 |
| Comet ® [1] Powder | 6.7 |
| Comet ® [1] Liquid | 2.7 |

[1]Registered trademark of Procter & Gamble Co., Cincinnati, Ohio

In TABLE VI, all conditions were as in TABLE V above, however, the soil was calcium stearate on glazed black ceramic tiles to duplicate typical soap scum.

TABLE VI

| SOAP SCUM REMOVAL | |
|---|---|
| PRODUT | VISUAL GRADE |
| Example 11 | 7.5 |
| Comet ® [1] Powder | 5.6 |
| Comet ® [1] Liquid | 2.2 |

[1]Registered trademark of Procter & Gamble Co, Cincinnati, Ohio.

In TABLE VII, conditions differed from those TABLES V and VI above. The soil was tea on etched porcelain enameled steel plates, which soil was "fixed" with ferrous sulfate. The tested products were left to soak on the resulting stains for the two indicated times, then rinsed. The same grading scales and protocol were used, except that four impartial judges were used and the results are an averaged score from two replicates.

TABLE VII

| TEA STAIN BLEACHING | | |
|---|---|---|
| PRODUCT | VISUAL GRADE (After 10 Seconds) | VISUAL GRADE (After 30 Seconds) |
| Example 11 | 9.0 | 9.4 |
| Comet ® [1] Powder 1:1[2] | 5.9 | 9.1 |
| Comet ® [1] Powder 3:1[3] | 2.5 | 3.4 |
| Comet ® [1] Liquid | 8.0 | 9.3 |

[1]Registered trademark of Procter & Gamble Co., Cincinnati, Ohio.
[2]Added as a 1:1 product:water slurry.
[3]Added as a 3:1 product:water slurry Review of the above experimental data shows that the compositions of the invention have excellent bleach half-life stability, lack of syneresis, ability to stably suspend abrasives, and maintain these advantageous features over extended times and at elevated temperatures. Their performances as shown in TABLES IV–VI, are overall better than any of the leading commercial products depicted over a wide range of soils.

The above examples have been depicted solely for purposes of exemplification and are not intended to restrict the scope or embodiments of the invention. The invention is further illustrated with reference to the claims which follow hereto.

What is claimed is:

1. A hard surface liquid abrasive scouring cleanser comprising:

(a) a colloidal aluminum oxide thickener;

(b) an electro/buffer in an amount sufficient to promote an environment in which the surfactant of (c) and the aluminum oxide of (a) can favorably associate;

(c) a bleach-stable nonionic surfactant which is an amine oxide;

(d) a halogen bleach; and (e) a particulate abrasive to provide scouring action; said aluminum oxide and said surfactant being present in a mixture suitable for providing bleach stability, substantial lack of phase separation and stable suspension of the abrasive.

2. The cleanser of claim 1, wherein the electrolyte/-buffer is selected from the group consisting essentially of: polyphosphates, pyrophosphates, triphosphates, tetrapyrophosphates, metasilicates, polysilicates, carbonates, hydroxides; the alkali metal salts thereof; and mixtures thereof.

3. The cleanser of claim 1 wherein the bleach is selected from the group consisting essentially of the alkali metal and alkaline earth salts of hypohalite, haloamines, haloimines, haloamides and haloimides.

4. The cleanser of claim 1 wherein the particulate abrasive is silica sand.

5. The cleaner of claim 1 wherein the surfactant of (c) comprises a mixture of anionic surfactant and the amine oxide.

6. The cleanser of claim 5 wherein the anionic surfactant is a secondary alkane sulfonate.

7. The hard surface cleanser of claim 1 wherein the surfactant of (c) further comprises an anionic surfactant selected from the group consisting essentially of alkali metal alkyl sulfates, secondary alkane sulfonates, linear alkyl benzene sulfonates, and mixtures thereof.

8. The cleanser of claim 1 wherein the aluminum oxide monohydrate is present in an amount of about 1% to 25%, the electrolyte/buffer is present in an amount of about 1% to 25%, the surfactant is present in an amount of about 0.1% to 15%, the bleach is present in an amount of about 0.25 to 15%, and the abrasive is present in an amount of about 5 to 70%, all based on the weight of the cleanser.

9. The cleanser of claim 8 wherein the half-life of the bleach is over 250 hours at 50° C.

10. The cleanser of claim 8 wherein there is substantially no syneresis.

11. An aqueous hard surface liquid abrasive cleanser with substantially no syneresis comprising:

(a) a colloidal alumina thickener;

(b) A mixed surfactant system which comprises at least one anionic surfactant which is selected from the group consisting essentially of alkali metal, alkyl sulfates, secondary alkane sulfonates, and mixtures thereof; and at least one bleach-stable nonionic surfactant which is an amine oxide;

(c) an electrolyte/buffer in an amount sufficient to promote an environment in which the surfactant system and the alumina can favorably associate;

(d) a halogen bleach; and (e) a particulate abrasive to provide scouring action; said alumina and said surfactant being present in a mixture suitable to provide bleach stability, substantial lack of phase separation and stable suspension of the abrasive.

12. The cleanser of claim 11 wherein the buffer/electrolyte of (c) is selected from the group consisting essentially of: polyphosphates, pyrophosphates, triphophates, tetrapyrophosphates, metasilicates, polysilicates, carbonates, hydroxides; the alkali metal salts thereof; and mixtures thereof.

13. The cleanser of claim 11 wherein the bleach is selected from the group consisting essentially of the alkali metal and alkaline earth salts of hypohalite, haloamines, haloimines, haloamides and haloimides.

14. The cleanser of claim 11 wherein the abrasive is silica sand.

15. The cleanser of claim 11 wherein the alumina is present in an amount of about 1% to 25%, the mixed surfactant system is present in an amount of about 0.1% to 15.0%, the electrolyte/buffer is present in an amount of about 1% to 25%, the bleach is present in an amount of about 0.25 to 15%, and the abrasive is present in an amount of about 5 to 70%, based on the weight of the cleanser.

16. The cleanser of claim 15 wherein the half-life of the bleach is over 250 hours at 50° C.

17. A hard surface abrasive liquid cleanser which does not require shaking before use in order to fluidize comprising:

(a) colloidal aluminum oxide thickener;
(b) at least one surfactant selected from anionic, bleach stable nonionic, amphoteric, zwitterionic and mixtures thereof;
(c) an electrolyte/buffer to promote the favorable environment in which the aluminum oxide and surfactant can associate;
(d) a halogen bleach;
(e) a particulate abrasive to provide scouring action; and
(f) the remainder, water;

said aluminum oxide and said surfactant being added together in sufficient amounts to ensure bleach stability, substantial lack of phase separation and stable suspension of said abrasives.

18. A hard surface abrasive cleanser which does not require shaking before use in order to fluidize comprising:

(a) about 0.1 to 25.0% colloidal aluminum oxide thickener;
(b) about 0.1 to 15% of at least one surfactant selected from anionic, bleach stable nonionic, amphoteric, zwitterionic and mixtures thereof;
(c) about 1.0 to 25.0% of an electrolyte/buffer to promote the favorable environment in which the aluminum oxide and surfactant can associate;
(d) about 0.25 to 15.0% of a halogen bleach;
(e) about 5 to 70% of a particulate abrasive to provide scouring action; and
(f) the remainder, water;

all of which combine to produce a liquid, flowable cleanser which has bleach stability, substantial lack of phase separation and stable suspension of said abrasives.

19. An aqueous hard surface abrasive liquid cleanser which does not require shaking before use in order to fluidize comprising:

(a) colloidal alumina thickener;
(b) a mixed surfactant system which comprises at least one anionic surfactant and one bleach-stable nonionic surfactant;
(c) an electrolyte/buffer to promote the favorable environment in which the aluminum oxide and surfactant can associate;
(d) a halogen bleach;
(e) a particulate abrasive to provide scouring action; and
(f) the remainder, water;

said aluminum oxide and said surfactants being added together in sufficient amounts to ensure bleach stability, substantial lack of phase separation and stable suspension of said abrasives.

20. An aqueous surface abrasive cleanser which does not require shaking before use in order to fluidize comprising;

(a) about 0.1 to 25.0% colloidal aluminum oxide thickener;
(b) about 0.1 to 15% of a mixed surfactant system which comprises at least one anionic surfactant and one bleach-stable nonionic surfactant
(c) about 1.0 to 25.0% of an electrolyte/buffer to promote the favorable enviornment in which the aluminum oxide and surfactants can associate;
(d) about 0.25 to 15.0% of a halogen bleach;
(e) about 5 to 70% of a particulate abrasive to provide scouring action; and
(f) the remainder, water;

all of which combine to produce a liquid, flowable cleanser which has bleach stability, substantial lack of phase separation and stable suspension of said abrasives.

21. A method for cleaning a hard surface comprising: contacting the hard surface having a stain thereon with a hard surface liquid abrasive scouring cleanser which comprises:

(a) a colloidal aluminum oxide thickener;
(b) an electrolyte/buffer in an amount sufficient to provide an environment in which the surfactant of (c) and the alumina of (a) can favorably associate;
(c) a bleach-stable nonionic surfactant which is an amine oxide;
(d) a halogen bleach; and
(e) a particulate abrasive to provide scouring action;

said aluminum oxide and said surfactant being present in a mixture suitable to provide bleach stability, substantial lack ph phase separation and stable suspension of said abrasives; and removing the cleanser and stain; and removing the stain.

22. A method for preparing a hard surface liquid abrasive scouring cleanser comprising:

combining (a) a colloidal aluminum oxide thickener;
(b) an electrolyte/buffer in an amount sufficient to provide an environment in which the surfactant of (c) and the alumina of (a) can favorably associate
(c) a bleach-stable nonionic surfactant which is an amine oxide;
(d) a halogen bleach; and
(e) a particulate abrasive to provide scouring action;

said aluminum oxide and said surfactant being present in a mixture suitable to provide bleach stability, substantial lack of phase separation and stable suspension of said abrasives; and removing the cleanser and stain.

* * * * *